United States Patent [19]

Habeeb et al.

[11] Patent Number: 5,035,815

[45] Date of Patent: Jul. 30, 1991

[54] LUBRICATING OIL CONTAINING A NICKEL ALKOXYALKYLXANTHATE AND ZINC DIALKYLDITHIOPHOSPHATE

[75] Inventors: Jacob J. Habeeb, Westfield, N.J.; Gopal H. Singhal; Rustom M. Billimoria, both of Baton Rouge, La.; William H. Stover, Sarnia, Canada

[73] Assignee: Exxon Research and Engineering Company, Florham Park, N.J.

[21] Appl. No.: 404,246

[22] Filed: Sep. 7, 1989

[51] Int. Cl.[5] ..... C10M 135/14; C10M 137/06

[52] U.S. Cl. ..... 252/32.7 E; 252/33.6; 252/35; 252/42.7

[58] Field of Search ..... 252/33.75, 33, 33.6, 252/46.4, 47, 48.2

[56] References Cited

U.S. PATENT DOCUMENTS

| | | | |
|---|---|---|---|
| 2,335,017 | 11/1943 | McNab et al. | 252/40.5 |
| 2,694,682 | 11/1954 | Harle | 252/33.6 |
| 4,178,258 | 12/1979 | Papay et al. | 252/32.7 E |

*Primary Examiner*—Prince E. Willis
*Assistant Examiner*—Ellen M. McAvoy
*Attorney, Agent, or Firm*—John W. Ditsler

[57] ABSTRACT

The addition of a metal alkoxyalkylxanthate and a metal thiophosphate to a lubricating oil results in an unexpected synergistic improvement in the antiwear performance of the oil. Nickel ethoxyethylxanthate and zinc dialkyldithiophosphate are most preferred additives.

9 Claims, 1 Drawing Sheet

LUBRICATING OIL CONTAINING A NICKEL ALKOXYALKYLXANTHATE AND ZINC DIALKYLDITHIOPHOSPHATE

BACKGROUND OF THE INVENTION

1. Field of the Invention

This invention relates to a lubricating oil composition having improved antiwear performance due to the presence of a metal alkoxyalkylxanthate and a metal thiophosphate.

2. Description of Related Art

Engine lubricating oils require the presence of additives to protect the engine from wear. For almost forty years, the principal antiwear additive for engine lubricating oils has been zinc dialkyldithiophosphate (ZDDP). However, ZDDP must be used in concentrations of 1.4 wt. % or greater to be effective. Since phosphates may result in the deactivation of emission control catalysts used in automotive exhaust systems, a reduction in the amount of phosphorus-containing additives (such as ZDDP) in the oil would be desirable. In addition, ZDDP alone does not provide the enhanced antiwear protection necessary in oils used to lubricate today's small, high performance engines.

The use of metal xanthates in lubricating oil is also known. For example, U.S. Pat. No. 2,335,017 discloses the addition of a metal-containing sulfur compound and a tertiary aliphatic ether or a phenol to a lubricating oil to improve the oil's detergent and anticorrosion properties. Several classes of metallic sulfur compounds are disclosed as being suitable, including metal xanthates of the formula

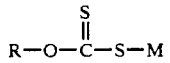

wherein M is a metal and R is an aliphatic or aromatic radical which may contain further substituted atoms or groups such as—O (alkyl). However, there is no mention of a metal thiophosphate being present nor of any improvement in the antiwear performance of the oil.

In addition, certain metal alkoxyalkylxanthates are known. For example, the reaction of nickel methoxyethylxanthate with other compounds has been studied (see Inoro. Chem. Vol. 18, no. 12, pp. 3612–15 (1979)) as has the decomposition of potassium methoxyethylxanthate (see J. Oro. Chem., Vol. 44, no. 10, pp. 1664–9 (1979)). Also, sodium ethoxyethylxanthate and potassium ethoxyethylxanthate are known (see European Patent Application 131,374 and U.S. Pat. No. 3,965,137, respectively). But there is no suggestion of using these compounds in lubricating oils.

However, none of these publications suggest that the antiwear performance of a lubricating oil can be synergistically enhanced when a metal alkoxyalkylxanthate and a metal thiophosphate are present therein.

SUMMARY OF THE INVENTION

This invention concerns a lubricating oil containing antiwear reducing amounts of certain metal xanthates and a metal thiophosphate. More specifically, we have discovered that the antiwear performance of a lubricating oil is synergistically enhanced when the oil contains a minor amount of a metal alkoxyalkylxanthate and a metal thiophosphate. Nickel ethoxyethylxanthate and zinc dialkyldithiophosphate are particularly preferred metal alkoxyalkylxanthates and metal thiophosphates, respectively.

DETAILED DESCRIPTION OF THE INVENTION

Figure 1:
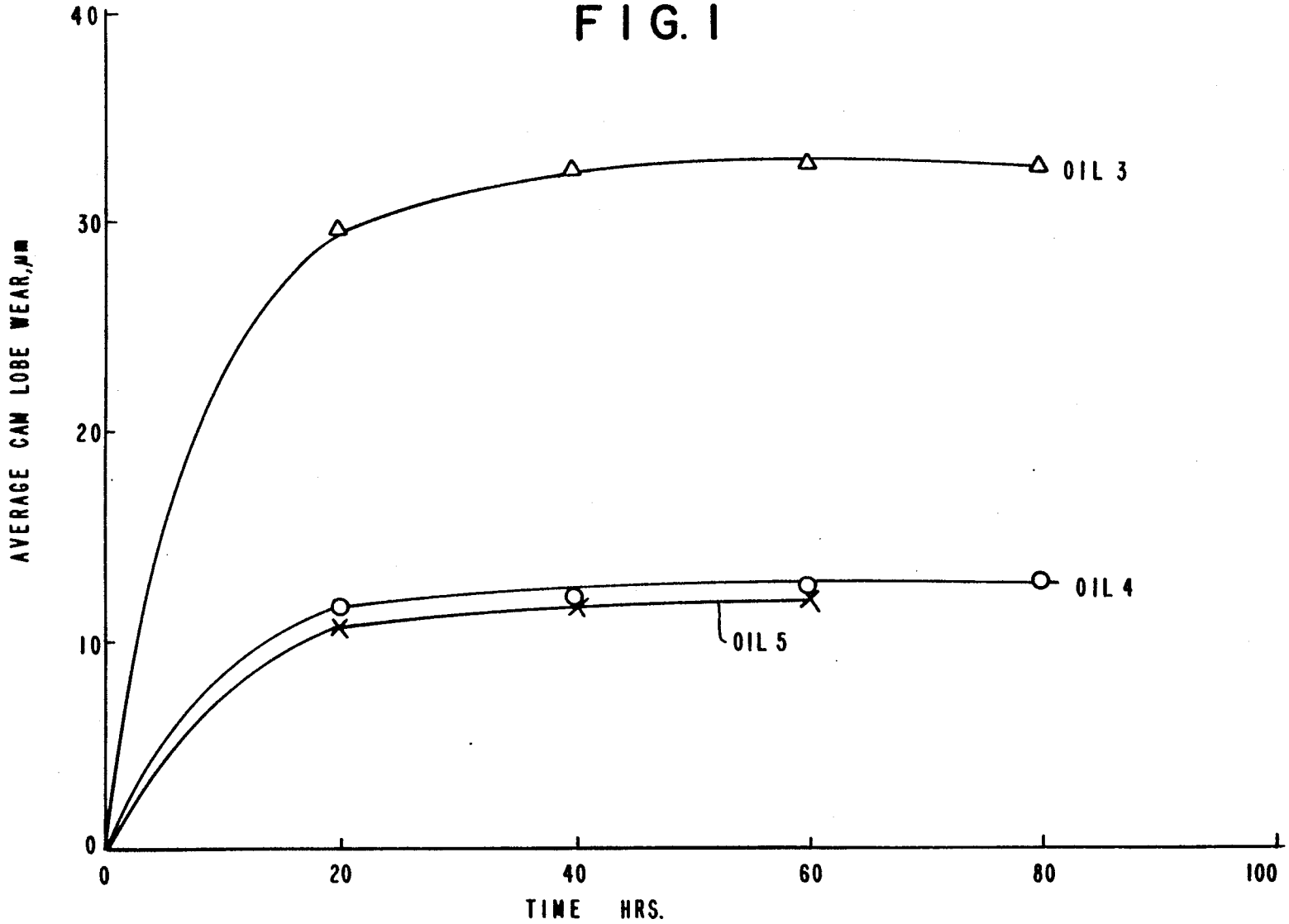
FIG. 1 is a plot of average cam lobe wear versus time for three different oil formulations.

In one embodiment, this invention concerns a lubricating oil composition comprising (a) a lubricating oil basestock, (b) a metal alkoxyalkylxanthate, and (c) a metal thiophosphate In another embodiment, this invention concerns a method for reducing the wear of an internal combustion engine by lubricating the engine with an oil containing an oil soluble additive system comprising a metal alkoxyalkylxanthate and a metal thiophosphate.

In general, the lubricating oil will comprise a major amount of a lubricating oil basestock (or base oil) and a minor amount of an additive system which contains a metal alkoxyalkylxanthate and a metal thiophosphate. If desired, other conventional lubricating oil additives may be present in the oil as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof): alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The metal alkoxyalkylxanthate used in this invention has the general formula $$(R_1-O-R_2-O-\overset{\overset{\displaystyle S}{\|}}{C}-S)_nM_x^mO_yS_z$$

where $R_1$ is an alkyl group (straight, branched, or cyclic); an alkoxy substituted alkyl group; a polyalkoxy substituted alkyl group; an aryl group; or a substituted aryl group, $R_2$ is a straight or branched alkylene group, M is a metal, m is the oxidation state of the metal, n is an integer from 1 to 4, x is an integer from 1 to 2, and y+z is an integer from 0 to 4.

Preferably $R_1$ is a straight alkyl group, a branched alkyl group, or an alkoxy substituted alkyl group. Most preferably, $R_1$ comprises a straight chained alkyl group. Although the number of carbon atoms in $R_1$ could vary broadly, typically $R_1$ will have from 1 to 24, preferably from 2 to 12, and more preferably from 2 to 8, carbon atoms. Typically, $R_2$ will have from 2 to 8, preferably from 2 to 4, carbon atoms. Most preferably, $R_1$ and $R_2$ will each have from 2 to 4 carbon atoms. $R_1$ and $R_2$ together should contain a sufficient number of carbon atoms such that the metal alkoxyalkylxanthate is soluble in the oil. Examples of suitable substituted groups in $R_1$ include alkyl, aryl, hydroxy, alkylthio, amido, amino, keto, ester groups, and the like.

M can be a variety of metals, but, in general, will comprise a metal selected from the group consisting of cadmium, chromium, germanium, hafnium, indium, manganese, nickel, niobium, tantalum, titanium, vanadium, and wolfram. Preferred metals are chromium and nickel, with nickel being most preferred.

m is the oxidation state of M and, typically, will be an integer ranging from 1 to 6, preferably from 2 to 4. Similarly, n, x, y, and z are integers whose values will vary as shown in Table 1 below.

TABLE 1

| m | n | x | y + z |
|---|---|---|---|
| 1 | 1 | 1 | 0 |
| 2 | 2 | 1 | 0 |
| 3 | 1,3 | 1 | 0,2 |
| 4 | 2–4 | 1,2 | 1–4 |
| 5 | 2–4 | 1,2 | 1–4 |
| 6 | 2–4 | 1,2 | 1–4 |

Examples of the various metal alkoxyalkylxanthates that can be used in this invention are nickel methoxyethylxanthate, nickel ethoxyethylxanthate, nickel phenoxyethylxanthate, nickel butoxyethylxanthate, nickel propyloxyethylxanthate, nickel isopropyloxyethylxanthate, nickel ethoxyethoxyethylxanthate, nickel 2-ethylhexyloxyxanthate, chromium ethoxyethylxanthate, chromium butoxyethylxanthate, or mixtures thereof. Preferred metal alkoxyalkylxanthates are chromium ethoxyethylxanthates, nickel ethoxyethylxanthate, nickel butoxyethylxanthate, nickel 2-ethylhexyloxyxanthate, or mixtures thereof. Nickel ethoxyethylxanthate, nickel butoxyethylxanthate, or their mixtures are particularly preferred, with nickel ethoxyethylxanthate being most preferred.

The metal thiophosphates used in this invention preferably comprises a metal selected from the group consisting of Group IB, IIB, VIB, VIII of the Periodic Table, and mixtures thereof. A metal dithiophosphate is a preferred metal thiophosphate, with a metal dialkyldithiophosphate being particularly preferred. Copper, nickel, and zinc are particularly preferred metals, with zinc being most preferred. The alkyl groups preferably comprise from 3 to 10 carbon atoms. Particularly preferred metal thiophosphates are zinc dialkyldithiophosphates.

The amount of metal alkoxyalkylxanthate and metal thiophosphate used in this invention need be only that which is necessary to cause an enhancement in the antiwear performance of the oil. Typically, however, the concentration of the metal alkoxyalkylxanthate in the lubricating oil will range from about 0.1 to about 5 wt. %, preferably from about 0.2 to about 1.5 wt. %, of the lubricating oil. Similarly, the concentration of the metal thiophosphate will range from about 0.1 to about 2 wt. %, preferably from about 0.3 to about 1 wt. %, of the lubricating oil.

Metal thiophosphates are commercially available from a number of vendors. As such, their method of manufacture is well known to those skilled in the art. Metal alkoxyalkylxanthates can be prepared by the procedures disclosed in copending application U.S. Ser. No. 404,135 filed on the same date herewith and shown in Examples 1 and 2 below.

The additives (or additive system) of this invention can be added directly to the lubricating oil. Often, however, they can be made in the form of an additive concentrate to facilitate handling and introduction of the additives into the oil. Typically, the concentrate will contain a suitable organic diluent and from about 10 to about 90 wt. %, preferably from about 30 to about 80 wt. %, of the additives. Suitable organic diluents include mineral oil, naphtha, benzene, toluene, xylene, and the like. The diluent should be compatible (e.g. soluble) with the oil and, preferably, substantially inert.

The lubricating oil (or concentrate) may also contain other additives known in the art such that a fully formulated oil is formed. Such additives include dispersants, other antiwear agents, antioxidants, corrosion inhibitors, detergents, pour point depressants, extreme pressure additives, viscosity index improvers and the like. These additives are typically disclosed, for example, in "Lubricant Additives" by C. V. Smalheer and R. Kennedy Smith, 1967, pp. 1-11 and in U.S. Pat. No. 4,105,571, the disclosures of which are incorporated herein by reference. These additives are present in proportions known in the art.

A lubricating oil containing the additive system of this invention can be used in essentially any application where wear protection is required. Thus, as used herein, "lubricating oil" (or "lubricating oil composition") is meant to include automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like. The additive system of this invention can also improve the antioxidation and rubber seal compatibility properties of the oil.

This invention may be further understood by reference to the following examples which are not intended to restrict the scope of the claims.

Experimental Procedure

Valve train wear tests were performed in the following examples utilizing a Ford 2.3 liter engine with the pistons and connecting rods removed. The engine was driven by an 11.2 KW (15 horsepower) DC drive motor through a 1.2 timing belt drive. The engine was equipped with Oldsmobile valve springs (146.5-148.3 KG) to increase the load between the cam lobes and the followers. Oil and coolant were circulated using engine mounted pumps. All test runs were made at an oil and coolant temperature of 90°±2° C., an oil pressure of 330±8 kPa, and an engine speed of 1,000±8 rpm, with periodic stoppage for wear measurements.

During operation, wear occurs on the lobes of the cam shaft and followers due to the sliding contact. Cam lobe wear was determined using the sequence V-D test described in ASTM Test No. STP 315H-Part 3 (the disclosure of which is incorporated herein by reference) by measuring the "head-to-toe" dimension (cam base circle diameter plus maximum lift) at room temperature using a digital micrometer. The difference between the dimensions of new and used cam lobes is a measure of the individual cam lobe wear, usually measured to an accuracy within about 2 microns. The individual cam lobe wear values from all eight lobes on the camshaft were averaged to provide a single value of average cam lobe wear.

EXAMPLE 1

Preparation of Nickel Ethoxyethylxanthate

About 300 ml (3 moles) of 2-ethoxyethanol and 210 ml (3.5 moles) of $CS_2$ (added dropwise) were mixed with a mechanically stirred solution of 198 g (3 moles) of potassium hydroxide in 150 ml of water in a beaker on an ice bath. Acetone (500 ml) was then added to the resulting thick orange liquid and the mixture stirred for another hour, after which a small amount of a dark orange layer settled at the bottom of the beaker. The top layer was transferred to another beaker. The bottom layer was again extracted with acetone and the acetone solutions were combined. A solution of 360 g (1.5 moles) of $NiCl_2,6H_2O$ in 800 ml of water was added (with mechanical stirring on an ice bath) to the acetone solutions. The mixture was diluted with 700 ml of an ice-water mixture and stirred for about one hour. The resulting solid was collected, washed well with water, and air dried.

For recrystallization, the solid was dissolved in hot ethyl acetate and filtered to remove small amounts of impurities. The filtrate was concentrated under reduced pressure to a small volume. Addition of heptane to the concentrated filtrate followed by cooling in an ice-bath gave 543 g (93% conversion) of a crystalline product having a melting point of 71.5°-72° C. Elemental analysis of the product gave the followWing results (in wt. %):

Found: C=31.05; H=4.70; Ni=15.40

Calculated for $C_{10}H_{18}O_4S_4Ni$: C=30.85; H=4.63; Ni=15.17

Infrared and proton NMR spectra were consistent with this structure.

Portions of this product were used to formulate Oils 1, 4, and 5 in Example 3 below.

EXAMPLE 2

Preparation of Nickel Butoxyethylxanthate

About 130 g (1 mole) of 2-butoxyethanol was added to a mechanically stirred solution of 66.5 g mole) of potassium hydroxide in 60 ml of water in a flask on an ice bath. This was followed by the dropwise addition of 70 ml of $CS_2$. After stirring the mixture for about one hour, 250 ml of acetone was added followed by a solution of 120 g (0.5 mole) of $NiCl_2,6H_2O$ in 350 ml of water. This mixture was stirred for another hour. The resulting green solid formed was collected by filtration, washed with water, and air dried. The solid was recrystallized from an acetone-water solution to give 183 g (82% conversion) of the product (m. p. 38°-40°). Elemental analysis of the product after a second recrystallization from petroleum ether gave the results shown below (in wt. %).

Found: C=38.23; H=5.86

Calculated for $C_{14}H_{26}O_4S_4Ni$: C=37.74; H=5.84

Infrared and proton NMR spectra were consistent With this structure.

A portion of this product was used to formulate Oil 2 in Example 3 below.

EXAMPLE 3

Formulation of Test Oils

Four test oils were formulated using a commercially available lubricating oil from which the antiwear additive had been removed and to which tertbutyl hydroperoxide (90 millimoles/1000 g oil, which is equivalent to about 1.2 wt. % hydroperoxide) was added to simulate actual used oil conditions. The test oils used are as follows:

Oil 1—contained 0.7 wt. % nickel ethoxyethylxanthate

Oil 2—contained 0.7 wt. % nickel butoxyethylxanthate

Oil 3—contained 1.4 wt. % ZDDP (0.11 wt. % P) and 0.6 wt. % of another antiwear additive (zinc dithiocarbamate)

Oil 4—contained 0.7 wt. % nickel ethoxyethylxanthate and 0.5 wt. % ZDDP.

Oil 5—contained 0.24 wt. % nickel ethoxyethylxanthate and 0.5 wt. % ZDDP.

EXAMPLE 4

Valve Train Wear Tests Using Oil 1 and Oil 2

Valve train wear tests were performed using Oils 1 and 2. Each test was run for only 40 hours to prevent engine seizure due to the high wear which occurred after 20 hours of operation. The average cam lobe wear in micrometers(μm) after 20 and 40 hours is shown in Table 2 below, but not in FIG. 1 because the wear exceeded the scale on the ordinate.

TABLE 2

| | Average Cam Lobe Wear (μm) | |
|---|---|---|
| Test Oil | 20 hr | 40 hr |
| Oil 1 | 51 | 109 |
| Oil 2 | 53 | 108 |

EXAMPLE 5

Valve Train Wear Test Using Oil 3

A test similar to Example 4 was performed using Oil 3. The average cam lobe wear obtained during 80 hours of operation is shown in FIG. 1.

EXAMPLE 6

Valve Train Wear Tests Using Oil 4 and Oil 5

Two tests similar to Example 4 were performed using Oil 4 and Oil 5. The average cam lobe wear obtained during 80 hours of operation is shown in FIG. 1.

The data in Table 2 and in FIG. 1 show that an unexpected synergistic improvement in the antiwear performance of a lubricating oil results when the oil contains a metal alkoxyalkylxanthate and a metal thiophosphate. The data also show that this additive system allows the formulation of a lubricating oil having enhanced antiwear performance at phosphorus levels significantly below those of conventional oils.

What is claimed is:

1. A lubricating oil composition which comprises a major amount of a lubricating oil basestock and (a) from about 0.2 to about 1.5 wt. % of a metal alkoxyalkylxanthate having the formula $$(R_1-O-R_2-O-\overset{\overset{S}{\|}}{C}-S)_nM_x{}^mO_yS_z$$

where $R_1$ is an alkyl group having from 2 to 4 carbon atoms, $R_2$ is a straight alkylene group having from 2 to 4 carbon atoms, M is nickel, m is 2, n is 2, x is 1, x+y is 0; and

(b) from 0.3 to about 1 wt. % of zinc dialkyldithiophosphate, wherein the amounts of (a) and (b) are synergistically effective in improving the antiwear properties of the lubricating oil composition.

2. The composition of claim 1 wherein the metal alkoxyalkylxanthate comprises at least one member selected from the group consisting of a nickel ethoxyethylxanthate, nickel butoxyethylxanthate, and mixtures thereof.

3. The composition of claim 2 wherein the metal alkoxyalkylxanthate comprises nickel ethoxyethylxanthate.

4. A method for reducing the wear of an internal combustion engine which comprises lubricating the engine with the lubricating oil composition of claim 1.

5. An additive concentrate suitable for blending with lubricating oils to provide a lubricating composition having improved antiwear performance which comprises an organic diluent and from about 10 to about 90 wt. % of an additive system containing (a) a metal alkoxyalkylxanthate having the formula $$(R_1-O-R_2-O-\overset{\overset{S}{\|}}{C}-S)_nM_x{}^mO_yS_z$$

where $R_1$ is an alkyl group having from 2 to 4 carbon atoms, $R_2$ is a straight alkylene group having from 2 to 4 carbon atoms, M is nickel, m is 2, n is 2, x is 1, y+z is 0; and (b) zinc dialkyldithiophoshpate wherein the amounts of (a) and (b) are synergistically effective in improving the antiwear properties of the lubricating oil composition.

6. The concentrate of claim 5 wherein the organic diluent is mineral oil, naphtha, benzene, toluene, or xylene.

7. The concentrate of claim 6 wherein the organic diluent comprises a mineral oil in which the additive system is soluble.

8. The concentrate of claim 5 wherein the metal alkoxyalkylxanthate comprises at least one member selected from the group consisting of nickel ethoxyethylxanthate, nickel butoxyethylxanthate, and mixtures thereof.

9. The concentrate of claim 8 wherein the metal alkoxyalkylxanthate comprises nickel ethoxyethylxanthate.

* * * * *